US007251451B2

(12) United States Patent
Takagi et al.

(10) Patent No.: US 7,251,451 B2
(45) Date of Patent: Jul. 31, 2007

(54) PRINTER HAVING OUTPUT TRAY

(75) Inventors: Masaaki Takagi, Daito (JP); Satoshi Kanaya, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 11/334,346

(22) Filed: Jan. 19, 2006

(65) Prior Publication Data

US 2006/0159500 A1 Jul. 20, 2006

(30) Foreign Application Priority Data

Jan. 20, 2005 (JP) ..... 2005-012854

(51) Int. Cl.
*G03G 15/00* (2006.01)

(52) U.S. Cl. ..... 399/405; 271/207; 271/213; 347/105

(58) Field of Classification Search ..... 399/397, 399/361, 363, 405, 365; 400/625, 646, 647, 400/691–693, 624, 671, 671.1; 271/163, 271/292, 207, 213; 374/101, 104, 105
See application file for complete search history.

(56) References Cited

U.S. PATENT DOCUMENTS 6,106,178 A * 8/2000 Chiu ..... 400/624
6,659,454 B1 * 12/2003 Smith et al. ..... 271/207

FOREIGN PATENT DOCUMENTS

JP 2004-035248 A 2/2004
JP 2004-181853 A 7/2004

* cited by examiner

*Primary Examiner*—Daniel J. Colilla
*Assistant Examiner*—N. Ha
(74) *Attorney, Agent, or Firm*—Crowell & Moring LLP

(57) ABSTRACT

While an output tray is housed in the printer body, a tray support supports the output tray in such a manner that has the output tray lifted off a surface on which the printer is placed. In the process of pulling out the output tray from the printer body, the tray support supports the output tray in such a manner that the rear end portion of the output tray gradually comes near to the surface on which the printer is placed, and guides the output tray so that a rib, which is formed on the front end portion of the output tray, and the rear end portion of the output tray are in contact with the surface on which the printer is placed when the output tray has been completely pulled out. The output tray is supported on the two portions, i.e., on the rib and rear end portion thereof, when it has been completely pulled out. Accordingly, it can be protected from bending due to the weight of paper sheets stacked thereon so as to prevent spillage of the paper sheets from the output tray even when the stacked paper sheets are large in quantity.

5 Claims, 5 Drawing Sheets

PRINTER HAVING OUTPUT TRAY

BACKGROUND OF THE INVENTION

1. Field of the Invention

The present invention relates to a printer having an output tray.

2. Description of the Related Art

Printers having an output tray that can be pulled out from the printer body are known in the art (see e.g. Japanese laid-open patent publication Nos. 2004-181853 and 2004-35248). As shown in FIG. 7A, such a printer 101 comprises an output tray 102 for holding ejected sheets of paper P thereon and a tray support 103 provided at the printer body for supporting the output tray 102 in such a manner that the output tray 102 can be pulled out from the lower part of the printer body along the direction a of ejection of the paper sheets P. Typically, this kind of output tray 102 is used with its front end positioned higher than the rear end so as to have the front end portion of the tray lifted off a surface F on which the printer is placed.

However, the conventional printer 101 has the following problem. When in use, the output tray 102 is supported so that the front end portion thereof is lifted off the surface F on which the printer is placed, as described above. This may cause the output tray 102 to be bent due to the weight of the paper sheets P stacked thereon, which may result in spillage of the paper sheets P from the output tray 102 as shown in FIG 7B.

SUMMARY OF THE INVENTION

An object of the present invention is to provide a printer that can prevent bending of an output tray due to the weight of paper sheets stacked on the tray and thus prevent spillage of the paper sheets from the output tray even when the stacked paper sheets are large in quantity.

According to an aspect of the present invention, a printer comprises: an output tray for holding a stack of paper sheets printed and ejected; and a tray support provided at a printer body for supporting the output tray in such a manner that the output tray can be pulled out from a lower part of the printer body along a direction of ejection of the paper sheets.

The output tray has a rib projecting downward from a front end portion of the output tray.

While the output tray is housed in the printer body, the tray support supports the output tray in such a manner that has the output tray lifted off a surface on which the printer is placed. In a process of pulling out the output tray, the tray support supports the output tray in such a manner that a rear end portion of the output tray gradually comes near to the surface on which the printer is placed, and the tray support guides the output tray so that the rib and the rear end portion of the output tray are in contact with the surface on which the printer is placed when the output tray has been completely pulled out.

With the above configuration, when the output tray has been completely pulled out, the rib at the front end of the tray and the rear end portion of the tray are in contact with the surface on which the printer is placed so that the output tray is supported on the two portions at the front and rear end thereof. Accordingly, even when a large amount of paper sheets are stacked on the output tray, the tray can be protected from bending, thus preventing spillage of the paper sheets from the tray.

Further, in the housed position, the output tray is supported to be lifted off the surface on which the printer is placed. Accordingly, when pulling out the output tray, a user can easily insert the fingers under the output tray to grasp the output tray. Moreover, by having the output tray lifted off the surface on which the printer is placed in the housed position, the output tray can be prevented from sticking on the surface.

Preferably, the output tray has a first boss projecting sideward from a position on the output tray adjacent the rear end of the output tray and a second boss projecting sideward from a position on the output tray in front of the first boss, wherein the tray support has: a first guide groove that is formed to face the first boss, and supports the first boss while the output tray is housed and frees the first boss from the supporting in the process of pulling out the output tray; and a second guide groove that is formed to face the second boss and has an inclined surface to guide the second boss from the housed position to the completely pulled out position of the output tray, the inclined surface sloping such that height thereof from the surface on which the printer is placed decreases from rear to front, wherein, while the output tray is housed, the tray support supports the first boss by the first guide groove and supports the second boss by the second guide groove so as to support the output tray in such a manner that has the output tray lifted off the surface on which the printer is placed; wherein, in the process of pulling out the output tray, the tray support frees the first boss from the supporting while supporting the second boss by the second guide groove so as to support the output tray in such a manner that the rear end portion of the output tray gradually comes near to the surface on which the printer is placed.

Preferably, the first guide groove is arranged substantially parallel to the second guide groove so as to be located above the second guide groove and located behind the second guide groove by a distance between the first and second bosses, and the first guide groove has a communicating portion that is in communication with the second guide groove, the communicating portion being provided at an area where the first and second guide grooves overlap vertically so as to free the first boss from the supporting in the process of pulling out the output tray.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DESCRIPTION OF THE PREFERRED EMBODIMENTS

Referring now to the accompanying drawings, a printer embodying the present invention is described. It is to be noted that the following description of preferred embodiment of the present invention has been presented for purposes of illustration and description, and is not intended to be exhaustive or to limit the present invention to the precise form disclosed.

Figure 1:
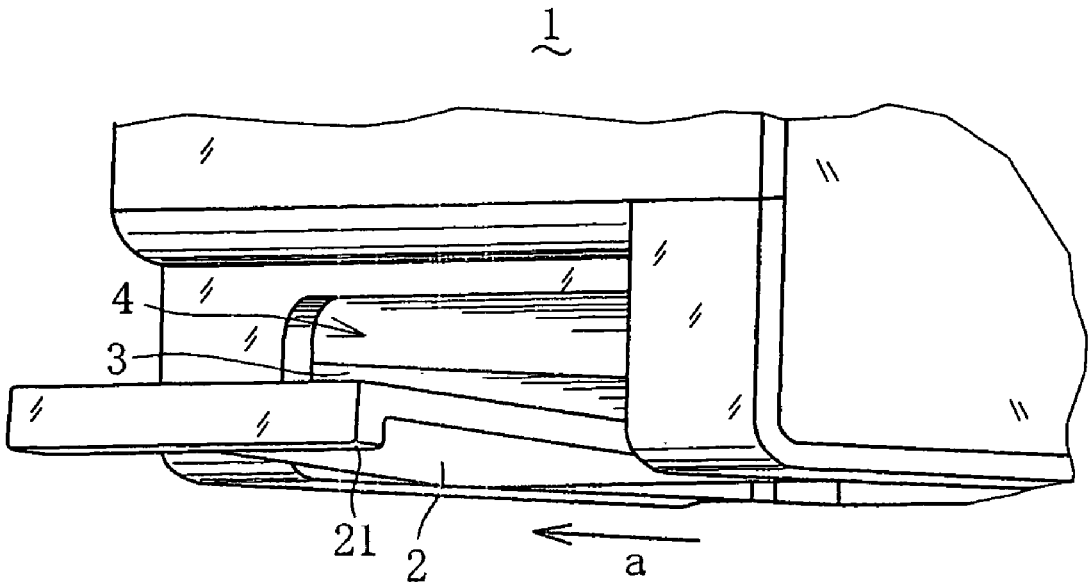
FIG. 1 is a perspective view showing an output tray and portions around the tray of a printer according to one embodiment of the present invention.

The printer 1 according to this embodiment is an apparatus that prints an image on a sheet of paper or the like based on image data (and/or text data) input via a device such as a personal computer connected thereto. As shown in FIG. 1, the printer 1 comprises an output tray 2 that holds a stack of paper sheets printed and ejected through a paper exit 4 and a tray support 3 that supports the output tray 2. In FIG. 1, the direction in which the output tray 2 is pulled out (the direction of ejection of a paper sheet) is indicated by an arrow a. Further, there is shown a rib 21 formed on the output tray 2.

Figure 2:
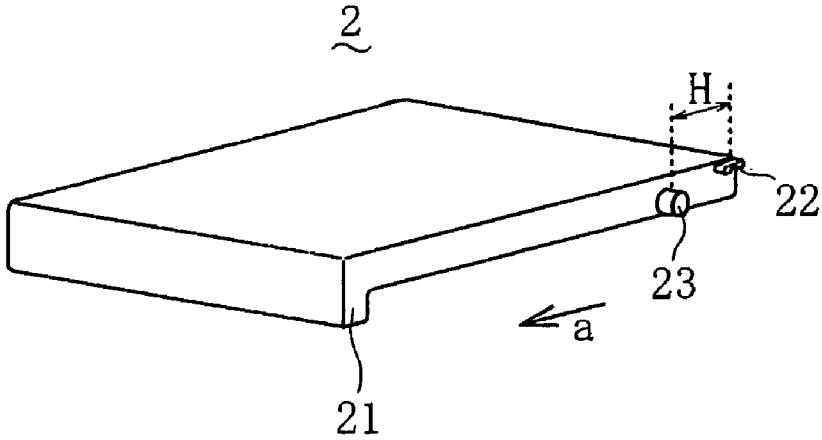
FIG. 2 is a perspective view of the output tray.

As shown in FIG. 2, the output tray 2 has the rib 21 projecting downward from the front end portion of the output tray 2, a first boss 22 projecting sideward from a position on the output tray 2 adjacent the rear end of the tray 2, and a second boss 23 projecting sideward from a position on the output tray 2 that is in front of the first boss 22 by a predetermined distance H. The second boss 23 is formed longer than the first boss 22.

Figure 3A:
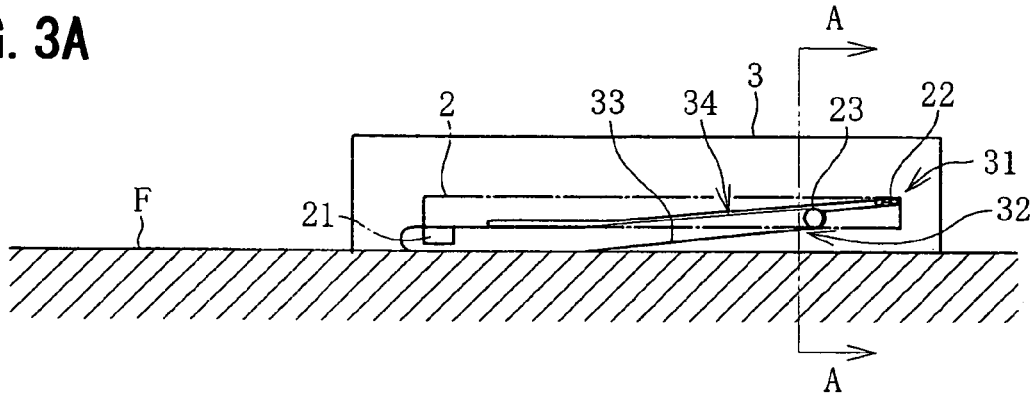
FIGS. 3A, 3B, and 3C are side views of the output tray and a tray support of the printer, showing the output tray housed in the printer body, partway pulled out, and completely pulled out, respectively.
Figure 3B:
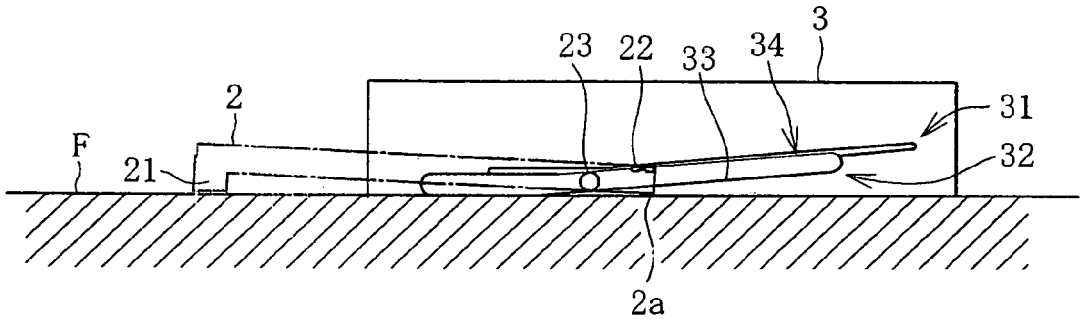
Figure 3C:
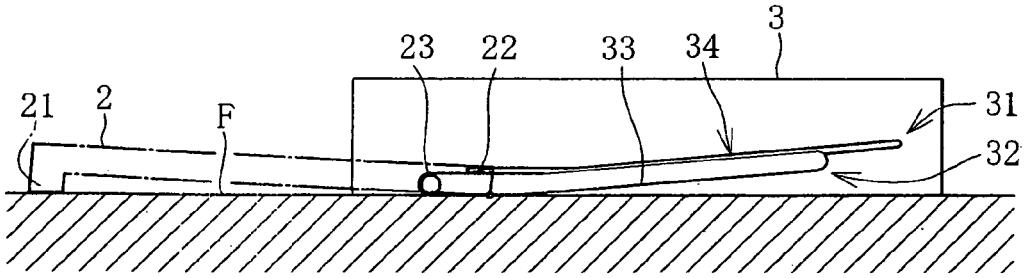

The tray support 3 is provided at the printer body for supporting the output tray 2 in such a manner that the output tray 2 can be pulled out from the lower part of the printer body along the direction a of paper ejection. FIGS. 3A to 3C are side views showing only the output tray 2 and tray support 3 of the printer 1. FIGS. 3A, 3B, and 3C show the output tray 2 housed in the printer body, partway pulled out from the printer body, and completely pulled out to the limit, respectively. The respective positions of the output tray 2 are described later in detail. In FIGS. 3A to 3C, the first and second bosses 22 and 23 of the output tray 2 are shown by solid lines while the other portions of the output tray 2 are shown by dashed lines.

Figure 4:
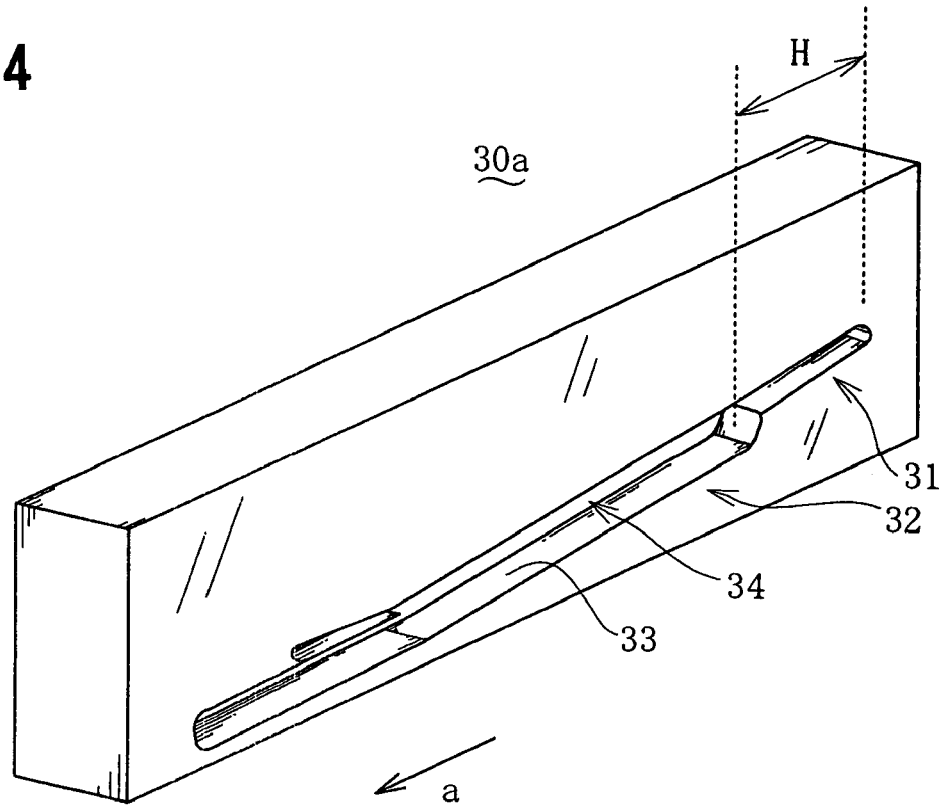
FIG. 4 is a perspective view showing one of two side walls of the tray support.
Figure 5:
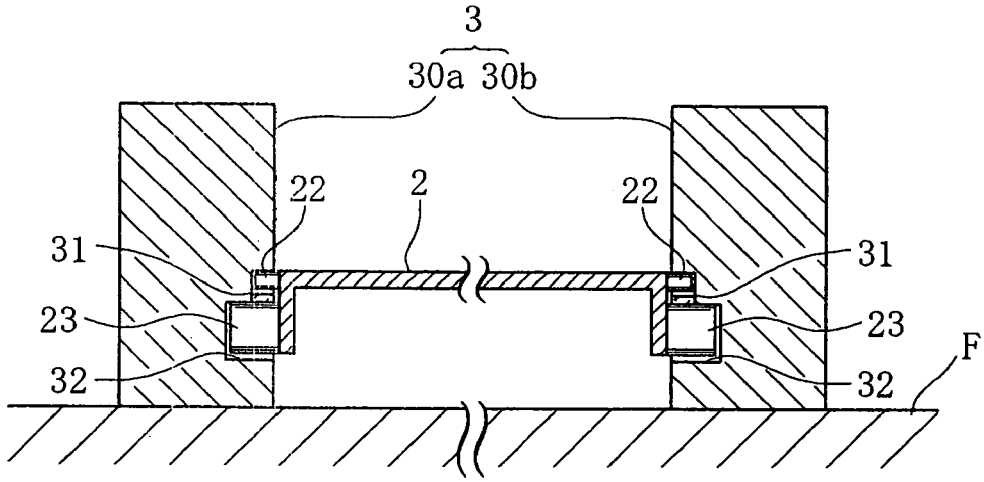
FIG. 5 is a cross sectional view taken along a line A-A in FIG. 3A.

As shown in FIG. 4 and FIG. 5, the tray support 3 has a pair of side walls 30*a* and 30*b* facing each other inside the printer body. Formed in each of the side walls 30*a* and 30*b* of the tray support 3 are a first guide groove 31 to receive the first boss 22 and a second guide groove 32 having a depth greater than that of the first guide groove 31 so as to receive the second boss 23.

The second guide groove 32 has an inclined surface 33 to guide the second boss 23 from the housed position to the completely pulled out position of the output tray 2. For the guiding, the inclined surface 33 slopes such that the height from the surface F on which the printer is placed decreases from rear to front.

It is to be noted that, in this description, the phrase "guiding the second boss by the second guide groove" is used to include both the case where the second guide groove 32 guides the second boss 23 while supporting the second boss 23 and the case where the second guide groove 32 guides the second boss 23 while only limiting the direction of movement of the second boss 23 (i.e., the case where the second boss 23 is not supported by the second guide groove 32), as distinguished from the phrase "supporting the second boss by the second guide groove". Likewise, the phrase "guiding the output tray by the tray support" is used to include both the case where the tray support 3 guides the output tray 2 while supporting the output tray 2 and the case where the tray support 3 guides the output tray 2 while only limiting the direction of movement of the output tray 2, as distinguished from the phrase "supporting the output tray by the tray support".

The first guide groove 31 is arranged substantially parallel to the second guide groove 32 so as to be located above the second guide groove 32 and located behind the second guide groove 32 by the distance H between the first and second bosses 22 and 23. The first guide groove 31 has a communicating portion 34, which is in communication with the second guide groove 32, at the area where the first and second guide grooves 31 and 32 overlap vertically. Provision of the communicating portion 34 enables the first guide groove 31 to free the first boss 22 from the supporting in the process of pulling out the output tray 2.

Figure 6A:
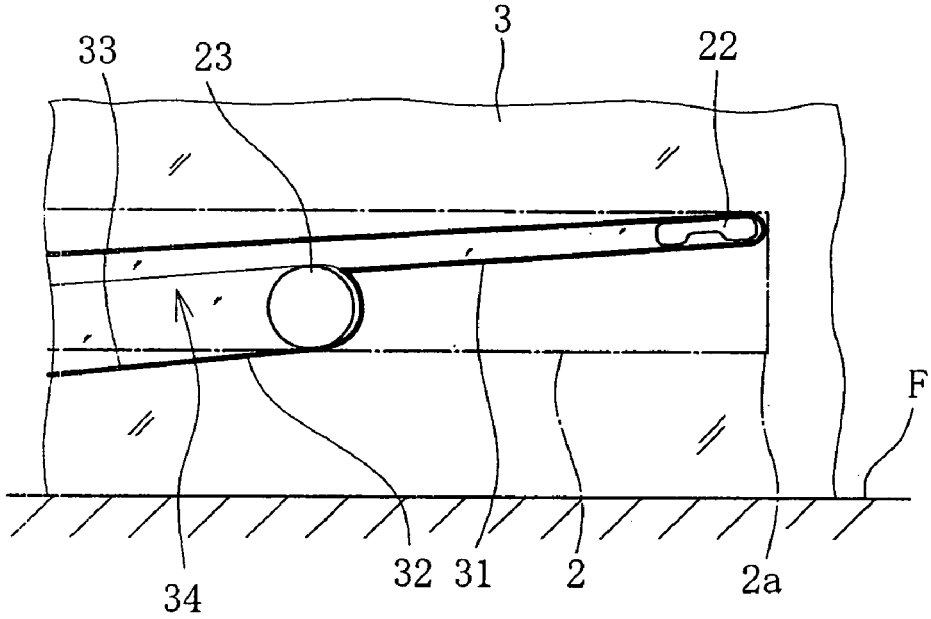
FIGS. 6A and 6B are side views of the rear end portion of the output tray, showing the housed position and the completely pulled out position, respectively, of the output tray.

While the output tray 2 is housed as shown in FIG. 3A and FIG. 6A, the tray support 3 supports the first and second bosses 22 and 23 by the first and second guide grooves 31 and 32, respectively, so as to support the output tray 2 in such a manner that has the output tray 2 lifted off the surface F on which the printer is placed.

In the process of pulling out the output tray 2 as shown in FIG. 3B, the tray support 3 frees the first boss 22 from the supporting at the communicating portion 34 while supporting the second boss 23 by the second guide groove 32 so as to support the output tray 2 in such a manner that the rear end portion 2*a* of the output tray 2 gradually comes near to the surface F on which the printer is placed. It would be appreciated that this embodiment allows a decreased contact area between the output tray 2 and the tray support 3 because the output tray 2 is supported by the tray support 3 only at the first and second bosses 22 and 23. Consequently, friction between the output tray 2 and the tray support 3 can be reduced so that the output tray 2 can be smoothly pulled out.

Figure 6B:
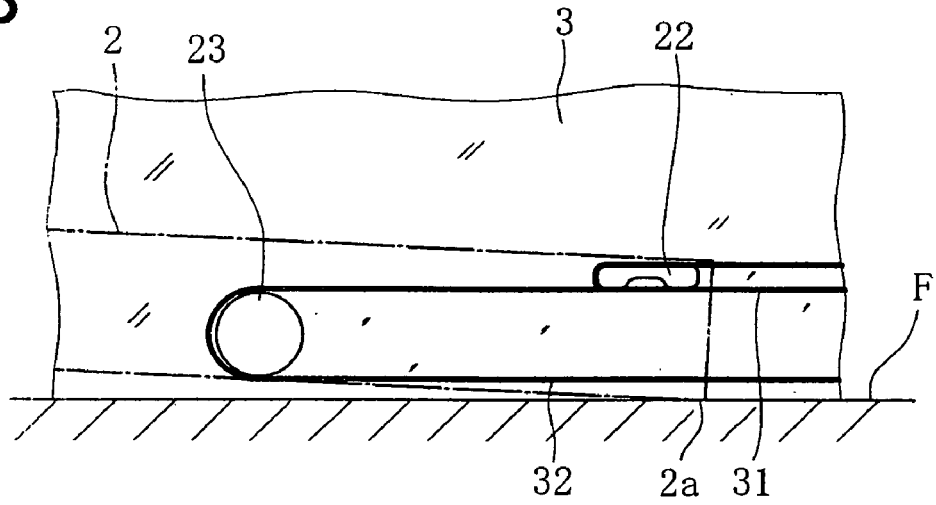
Figure 7A:
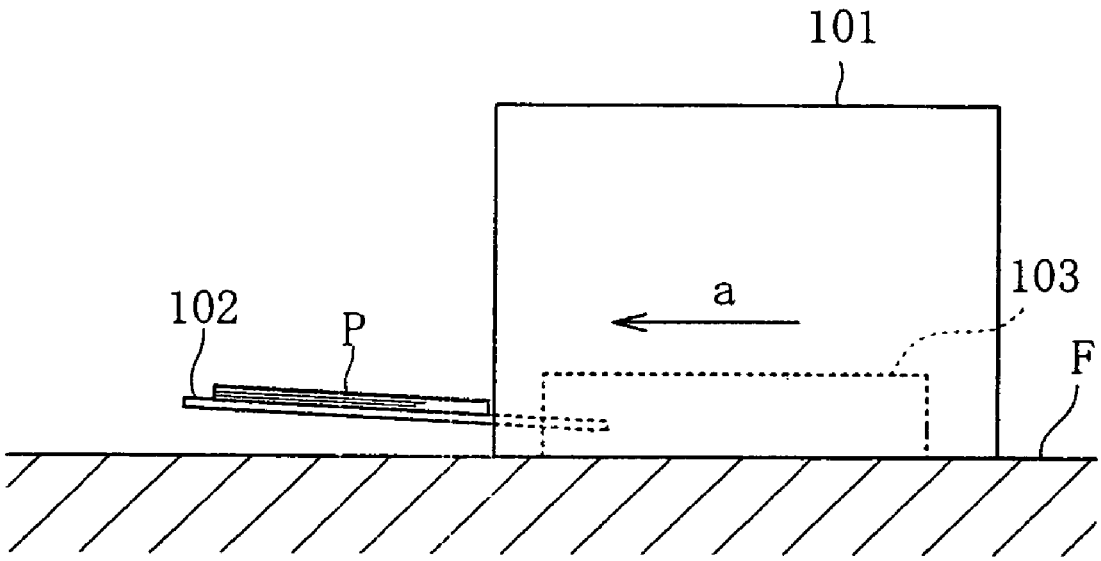
FIG. 7A PRIOR ART
FIG. 7A is a side view of the conventional printer.
Figure 7B:
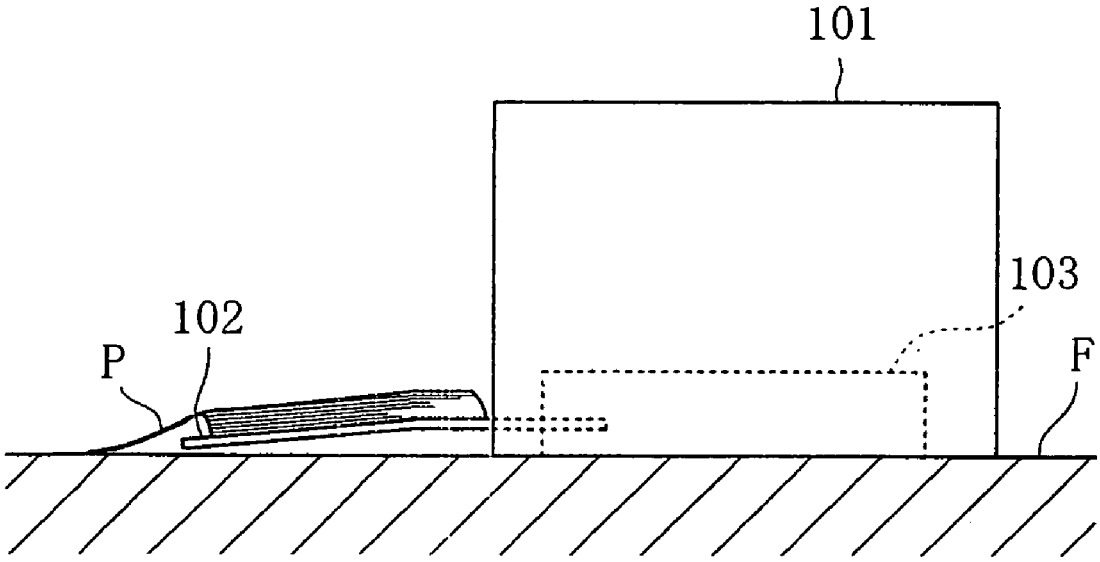
FIG. 7B PRIOR ART
FIG. 7B is a side view of the conventional printer of which the output tray is bent due to the weight of paper sheets.

The tray support 3 guides the output tray 2 so that the rib 21 and the rear end portion 2*a* of the output tray 2 are in contact with the surface F on which the printer is placed when the output tray 2 has been completely pulled out as shown in FIGS. 3C and 6B. In this completely pulled out position of the output tray 2, the first and second guide grooves 31 and 32 of the tray support 3 need not support the output tray 2 because the output tray 2 is supported on the rib 21 and the rear end portion 2*a* thereof.

According to the printer 1 of this embodiment as described above, when the output tray 2 is in the completely pulled out position (position as shown in FIG. 3C), the rib 21, which is provided at the front end portion of the tray 2, and the rear end portion 2*a* of the tray 2 are in contact with the surface F on which the printer is placed, so that the output tray 2 is supported on the two portions at the front and rear end thereof. Accordingly, even when a large amount of paper sheets are stacked on the output tray 2, the tray 2 can be protected from bending, thus preventing spillage of the paper sheets from the tray 2.

Further, in the housed position (position as shown in FIG. 3A), the output tray 2 is supported to be lifted off the surface F on which the printer is placed. Accordingly, when pulling out the output tray 2, a user can easily insert the fingers under the output tray 2 to grasp the output tray 2. Moreover, by having the output tray 2 lifted off the surface F on which the printer is placed in the housed position, the output tray 2 can be prevented from sticking on the surface F.

The present invention has been described above using a presently preferred embodiment, but those skilled in the art will appreciate that various modifications are possible. Accordingly, all such modifications are intended to be included within the spirit and scope of the present invention. For example, in the above described embodiment, the output tray 2 has the bosses 22 and 23 and the printer body has the guide grooves 31 and 32, but it is also possible to form bosses on the printer body and form guide grooves in the output tray.

This application is based on Japanese patent application 2005-12854 filed Jan. 20, 2005, the contents of which are hereby incorporated by reference.

What is claimed is:

1. A printer comprising:

an output tray for holding a stack of paper sheets printed and ejected; and a tray support provided at a printer body for supporting the output tray in such a manner that the output tray can be pulled out from a lower part of the printer body along a direction of ejection of the paper sheets, wherein the output tray has a rib projecting downward from a front end portion of the output tray, wherein, while the output tray is housed in the printer body, the tray support supports the output tray such that the output tray is spaced above a surface on which the printer is placed; and in a process of pulling out the output tray from within the printer body, the tray support is configured such that a rear end portion of the output tray gradually moves nearer to the surface on which the printer is placed, and the tray support guides the output tray so that the rib and the rear end portion of the output tray are in contact with the surface on which the printer is placed when the output tray has been completely pulled out.

2. The printer according to claim 1, wherein the rib extends below remainder of the output tray.

3. The printer according to claim 1, wherein the tray support has a sloped portion which provides for sloped movement of the end portion of the output tray during insertion of the output tray into the printer body and removal of the output tray from the printer body.

4. A printer comprising:

an output tray for holding a stack of paper sheets printed and ejected; and a tray support provided at a printer body for supporting the output tray in such a manner that the output tray can be pulled out from a lower part of the printer body along a direction of ejection of the paper sheets, wherein the output tray has a rib projecting downward from a front end portion of the output tray, wherein, while the output tray is housed in the printer body, the tray support supports the output tray in such a manner that has the output tray lifted off a surface on which the printer is placed; and in a process of pulling out the output tray, the tray support supports the output tray in such a manner that a rear end portion of the output tray gradually comes near to the surface on which the printer is placed, and the tray support guides the output tray so that the rib and the rear end portion of the output tray are in contact with the surface on which the printer is placed when the output tray has been completely pulled out, wherein the output tray has a first boss projecting sideward from a position on the output tray adjacent the rear end of the output tray and a second boss projecting sideward from a position on the output tray in front of the first boss, wherein the tray support has:

a first guide groove that is formed to face the first boss, and supports the first boss while the output tray is housed and frees the first boss from the supporting in the process of pulling out the output tray; and a second guide groove that is formed to face the second boss and has an inclined surface to guide the second boss from the housed position to the completely pulled out position of the output tray, the inclined surface sloping such that height thereof from the surface on which the printer is placed decreases from rear to front, wherein, while the output tray is housed, the tray support supports the first boss by the first guide groove and supports the second boss by the second guide groove so as to support the output tray in such a manner that has the output tray lifted off the surface on which the printer is placed;

wherein, in the process of pulling out the output tray, the tray support frees the first boss from the supporting while supporting the second boss by the second guide groove so as to support the output tray in such a manner that the rear end portion of the output tray gradually comes near to the surface on which the printer is placed.

5. The printer according to claim 4, wherein the first guide groove is arranged substantially parallel to the second guide groove so as to be located above the second guide groove and located behind the second guide groove by a distance between the first and second bosses, and the first guide groove has a communicating portion that is in communication with the second guide groove, the communicating portion being provided at an area where the first and second guide grooves overlap vertically so as to free the first boss from the supporting in the process of pulling out the output tray.

* * * * *